US006668598B2

(12) United States Patent
Miyake et al.

(10) Patent No.: US 6,668,598 B2
(45) Date of Patent: Dec. 30, 2003

(54) WARP KNITTED FABRIC

(75) Inventors: Yasushi Miyake, Nagaokakyo (JP); Naoki Kataoka, Kyoto (JP); Masataka Ikeda, Takatsuki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/187,892

(22) Filed: Jul. 3, 2002

(65) Prior Publication Data

US 2003/0094019 A1 May 22, 2003

(30) Foreign Application Priority Data

Jul. 4, 2001 (JP) ..... 2001-203777
Nov. 22, 2001 (JP) ..... 2001-357600

(51) Int. Cl.[7] ..... D04B 21/00
(52) U.S. Cl. ..... 66/195
(58) Field of Search ..... 66/178 R, 180, 66/172 E, 178 A, 192, 193, 195, 202; 442/308, 309, 310

(56) References Cited

U.S. PATENT DOCUMENTS 3,671,379 A 6/1972 Evans et al. ..... 161/173
3,973,073 A * 8/1976 Barbe et al. ..... 66/202
4,079,602 A * 3/1978 Blore ..... 66/196
4,117,194 A * 9/1978 Barbe et al. ..... 66/202
5,352,518 A * 10/1994 Muramoto et al. ..... 66/202
6,223,782 B1 * 5/2001 Watkins ..... 66/195

FOREIGN PATENT DOCUMENTS

| | | |
|---|---|---|
| EP | 1 059 372 A2 | 12/2000 |
| JP | 43-19108 | 8/1943 |
| JP | 44-2504 | 2/1944 |
| JP | 5-295634 | 11/1993 |
| JP | 9-268456 | 10/1997 |
| JP | 2000239927 A | 9/2000 |
| JP | 2000256918 A | 9/2000 |
| JP | 2001-55634 | 2/2001 |
| JP | 2002069707 A | 3/2002 |
| WO | WO 00/29653 | 5/2000 |

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

The present invention provides a warp knitted fabric containing a latent crimp fiber but no elastic fiber, and showing a stretchability of 60% or more in both the warp and weft directions, and a residual strain at 60% elongation recovery of 15% or less in both the warp and weft directions. The warp knitted fabric of the present invention shows little lowering of the stretchable functions during dyeing at high temperature, repeated washing, repeated stretching, or the like treatment, and is excellent in elongation recovery due to the high stretchability, surface smoothness and shape retention.

17 Claims, No Drawings

WARP KNITTED FABRIC

TECHNICAL FIELD

The present invention relates to a warp knitted fabric, and swimwear, sportswear and underwear in which the warp knitted fabric is used.

BACKGROUND ART

Sportswear and underwear suitably fitting the body and excellent in adaptability to body movement have recently been required, and there has been a great demand for stretch materials excellent in elongation recovery.

Knitted fabrics prepared by mixed knitting elastic fibers such as polyurethane-based elastic fibers and polyether ester-based elastic fibers (hereinafter abbreviated to elastic fibers) and knitted fabrics prepared by mixed knitting false-twisted yarns of poly(butylene terephthalate) fibers have heretofore been widely used for sportswear, underwear, and the like, as knitted fabrics having high stretchability and being excellent in elongation recovery. Moreover, for example, warp knitted fabrics excellent in surface smoothness and showing relatively excellent shape retention such as two-way tricot knitted fabrics prepared by knitting with a tricot knitting machine, and satin net fabrics and tricot net fabrics prepared by knitting with a Raschel knitting machine, have been widely used as clothing in particularly close contact with the body.

Although warp knitted fabrics prepared of mixed knitting elastic fibers are excellent in stretchability and elongation recovery, they have a relatively high density because the elastic fibers show low heat settability and a large shrinkage stress. Articles formed from the warp knitted fabrics therefore have a drawback of giving a heavy feeling to a wearer. Furthermore, the elastic fibers in the warp knitted fabrics show lowered stretchability or they are embrittled due to physical actions such as repeated stretching during wearing, repeated washing and tumbler drying after washing, and chemical actions such as active chlorine used for bleaching agents during washing and bactericides in a pool, organic lipid components contained in sebum and cosmetics and exposure to sunlight. As a result, the articles of the knitted fabrics have the drawback that they can be hardly used over a long period of time due to the lowering of the stretchability and a shape change thereof.

On the other hand, the knitted fabrics having elastic fibers have the following drawbacks. When the fabrics are pulled in the warp or weft direction and heat set in order to alleviate the heavy feeling, elastic fibers are exposed from the gaps of the knitted fabrics to impair the aesthetic appearance of the articles; and lowering of the functions and embrittlement of the elastic fibers are further accelerated by repeated washing of the articles, repeated stretching during wearing and the like. Furthermore, because the elastic fibers themselves have a high stretching force, the tension of the knitted fabrics must be controlled to a high degree in the knitting and dyeing stages for the purpose of not forming defects such as warp lines in the fabrics. Therefore, the knitted fabrics also have the problem of being costly.

On the other hand, using polyester-based synthetic fibers produced from poly(ethylene terephthalate), poly(butylene terephthalate), and the like that have a relatively firm resistance to the above chemical and physical actions in comparison with the elastic fibers, textured yarns having stretchability are prepared with known technologies such as false twisting and twisting, and clothing articles prepared from knitted fabrics in which the stretch textured yarns are used in place of the elastic fibers have been put on the market.

Warp knitted fabrics prepared by mixed knitting these false twisted yarns and twisted yarns have the following advantages: they are excellent in resistance to embrittlement and retain stretchability in an environment where the above chemical and physical actions are exerted on the fabrics; and they can be easily handled in the knitting and dyeing stages. However, because the false-twisted yarns and twisted yarns show a small stretching force in comparison with the elastic fibers, and have bulkiness, the knitted fabrics have the disadvantage that they have a coarse fullness and hardly show high stretchability. Moreover, the knitted fabrics formed from the false-twisted yarns and twisted yarns have disadvantages as explained below. An uneven effect and a crepe-like effect are produced on the surface of the knitted fabrics by the crimp of the false-twisted yarns and twisted yarns and, as a result, the knitted fabrics show poor resistance to pilling and snagging. Furthermore, because the bulkiness of the textured yarns increases friction among the yarns, the knitted fabrics have a drawback of showing low elongation recovery and shape stability.

Various composite yarns in which two polymer components are bonded in a side-by-side manner or in an eccentric core-sheath manner have been proposed as substitutes for the elastic fibers and, the false-twisted yarns and twisted yarns of polyester-based synthetic fibers, having drawbacks as explained above. For example, Japanese Examined Patent Publication (Kokoku) No. 44-2504 discloses a composite yarn prepared by eccentrically composite spinning two poly(ethylene terephthalate) polymer components differing from each other in intrinsic viscosity. Japanese Unexamined Patent Publication (Kokai) No. 5-295634 discloses a latent crimp composite yarn prepared by composite spinning in a side-by-side manner a poly(ethylene terephthalate) polymer and a copolymerized poly(ethylene terephthalate) polymer that is a large shrinkage component compared with the former polymer. Moreover, Japanese Examined Patent Publication (Kokoku) No. 43-19108 discloses a composite yarn for which a poly(trimethylene terephthalate) polymer and a poly(butylene terephthalate) polymer are used.

However, when these known composite yarns are used, only knitted fabrics showing poor stretchability have been obtained because the stretch force of these composite yarns is as small as that of the false-twisted yarns and twisted yarns explained above. Moreover, the side-by-side type or eccentric core-sheath type of composite yarns are rubbed with tension bars and guides on a warp knitting machine where from 10 to 40 of the yarns per 2.5 cm are arranged in parallel and knitted. As a result, spring-like peculiar crimp shapes are manifested, and single filaments of the composite yarns tend to be entangled and produce yarn breakage. Accordingly, the composite yarns have a drawback of being capable of producing only knitted fabrics that have a coarse density and is low in denseness. The present situation in knitted fabrics is, therefore, that knitted fabrics that simultaneously satisfy the properties required, namely, surface smoothness, denseness, stretchability and durable stretchability have not yet been obtained.

DISCLOSURE OF THE INVENTION

As a result of intensively carrying out investigations to solve the above problems, the present inventors have achieved the present invention.

That is, the present invention is as explained below.

1. A warp knitted fabric containing a latent crimp fiber and no elastic fiber, and showing a stretchability of 60% or more in both the warp and weft directions, and a residual strain at 60% elongation recovery of 15% or less in both the warp and weft directions.

2. The warp knitted fabric according to 1, wherein the latent crimp fiber is knitted at a blending ratio of 10% or more by weight based on the knitted fabric.

3. The warp knitted fabric according to 1 or 2, wherein the warp knitted fabric is formed from a latent crimp fiber and a non-latent crimp fiber, and the latent crimp fiber is mixed knitted at a blending ratio of from 10 to 80% by weight based on the knitted fabric.

4. The warp knitted fabric according to any one of 1 to 3, wherein the latent crimp fiber is compositely formed from two types of polyesters, and at least one of the polyesters is poly(trimethylene terephthalate).

5. The warp knitted fabric according to any one of 1 to 4, wherein the latent crimp fiber is compositely formed from two types of polyesters differing from each other in intrinsic viscosity by an amount of from 0.05 to 0.7 dl/g, in a side-by-side manner or in an eccentric core-sheath manner, and at least one of the polyesters is poly(trimethylene terephthalate).

6. The warp knitted fabric according to any one of 1 to 5, wherein the latent crimp fiber satisfies the following conditions (a) to (c):

(a) an initial tensile resistance of from 10 to 30 cN/dtex;

(b) a stretch elongation of crimp is from 10 to 100% and a stretch modulus of crimp is from 80 to 100%; and (c) a thermal shrinkage stress at 100° C. of from 0.1 to 0.5 cN/dtex.

7. The warp knitted fabric according to any one of 1 to 6, wherein the latent crimp fiber is compositely formed from two types of poly(trimethylene terephthalates) differing from each other in intrinsic viscosity in an amount of from 0.05 to 0.5 dl/g, in a side-by-side manner or in an eccentric core-sheath manner.

8. The warp knitted fabric according to any one of 3 to 7, wherein the non-latent crimp fiber is a polyester-based and/or polyamide-based synthetic fiber.

9. The warp knitted fabric according to any one of 1 to 8, wherein the latent crimp fiber is compositely formed from two types of poly(trimethylene terephthalates) differing from each other in intrinsic viscosity in an amount of from 0.05 to 0.3 dl/g, in a side-by-side manner.

10. The warp knitted fabric according to any one of 1 to 9, wherein the warp knitted fabric is formed from a latent crimp fiber and a non-latent crimp fiber, and the latent crimp fiber is mixed knitted in a blending ratio of from 25 to 80% by weight based on the knitted fabric.

11. The warp knitted fabric according to any one of 1 to 10, wherein the warp knitted fabric is formed from a latent crimp fiber and a non-latent crimp fiber, and the latent crimp fiber is mixed knitted in a blending ratio of from 35 to 80% by weight based on the knitted fabric.

12. The warp knitted fabric according to any one of 1 to 11, wherein the fullness ($L_wCF$) in the wale direction of the warp knitted fabric is from 500 to 1,500.

13. The warp knitted fabric according to any one of 1 to 12, wherein the ratio (number of wales/number of courses) of a knitted fabric density in the wale direction to a knitted fabric density in the course direction is from 0.6 or more to 1.0 or less.

14. The warp knitted fabric according to any one of 1 to 13, wherein the knitting stitch of the warp knitted fabric is a half tricot stitch.

15. Swimwear for which the warp knitted fabric according to any one of 1 to 14 is used.

16. Sportswear for which the warp knitted fabric according to any one of 1 to 14 is used.

17. Underwear for which the warp knitted fabric according to any one of 1 to 14 is used.

The warp knitted fabric of the present invention is an excellent one that is excellent in surface smoothness, shape stability, etc., as well as the adaptability to the body movement in the longitudinal and transverse directions without having a strained feel, and that can maintain these properties after repeated washing and repeated wearing.

The present invention is explained below in detail.

The warp knitted fabric of the present invention contains no elastic fiber. The elastic fiber is a fiber having an elongation of 300% or more, and is represented by a polyurethane-based elastic fiber, a polyether ester-based elastic fiber, and the like. As explained above, a knitted fabric for which an elastic fiber is used has drawbacks of giving a heavy feeling, losing its stretchability when it is repeatedly stretched during wearing, and being likely to be embrittled by chemical actions. The knitted fabric of the present invention is, therefore, characterized in that it contains no elastic fiber.

It is most appropriate to evaluate the resistance of the knitted fabric to such embrittlement and lowering of stretchability functions by sewing the knitted fabric in a desired clothing pattern to give articles, and actually using the articles. However, when the knitted fabric is actually used and evaluated, the results sometimes differ depending on differences in wearers' individual variation and wearing environments, and therefore the quantification of the results is difficult. As a result, a quantitative evaluation of the durability of the knitted fabric is conducted by model evaluation explained below.

For example, the model evaluation on assumptive sample swimwear worn in a pool is carried out in the following manner. A knitted fabric sample is immersed for 6 hours in a water bath having a volume of 50 l with an active chlorine concentration adjusted to 100 ppm (with sodium hypochlorite) and a pH adjusted to 7.0±0.5 (with hydrochloric acid), respectively, with the temperature set at 35° C. while the knitted fabric sample is being elongated by 30% in the warp or weft direction. The knitted fabric sample is then dehydrated, and air dried. The immersion treatment is repeated 5 times. The stress retention at 60% elongation of the knitted fabric sample is measured prior to and subsequently to the immersion treatment.

The stress at 60% elongation is a stress measured in accordance with JIS-L-1080 (Constant Rate Elongation Method), and is a stress of a knitted fabric sample 5 cm wide immediately after elongating the sample at a pulling rate of 300%/min based on the grip-to-grip distance of the sample prior to elongation until the elongation reaches 60%. The stress subsequent to immersion is calculated in terms of percentage based on the stress at 60% elongation prior to immersion, and is evaluated as stress retention.

The stress retention of the warp knitted fabric in the present invention is preferably from 40 to 100%, more preferably from 60 to 100%, and still more preferably from 80 to 100%. When the stress retention is in the above range, an article obtained from the knitted fabric give an excellent fitting feeling to the wearer. Moreover, the article does not give a tight feeling because the knitted fabric does not shrink.

Furthermore, the model evaluation on an assumptive sample and an underwear and a sportswear closely contacted with the body is carried out in the following manner. A 1:1 mixture of squalene (one of the components of sebum) and a nonionic surfactant (e.g., Emulgen 409P, manufactured by Kao Corporation) is diluted with water, and an aqueous 10% solution at 35° C. is prepared. A knitted fabric sample is immersed in the aqueous solution for 3 hours, dehydrated, and exposed to ultraviolet-rays for 20 hours with a carbon-type Fade-O-meter. The stress retention at 60% elongation prior to and subsequent to immersion and ultraviolet ray exposure is measured and evaluated by the above procedure. The stress retention of the knitted fabric in the model evaluation on assumptive sportswear and innerwear closely contacted with the body is also preferably from 40 to 100%, more preferably from 60 to 100%, and still more preferably from 80 to 100%.

The knitted fabric of the present invention is characterized in that it is a warp knitted one. Because the restraining force of knitted loops forming the knitted fabric is relatively high and fibers to be knitted are fed in the longitudinal direction of the knitted fabric, the warp knitted fabric is excellent in shape retention and surface smoothness in comparison with the flat knitted and tubular knitted fabrics. For clothing that is closely contacted with the body when used, deformation of the shape of the knitted fabric during wearing is very large in comparison with general outer garments such as outer-wear and casual wear. Clothing prepared from flat knitted fabrics and tubular knitted fabrics poor in shape retention, therefore, tends to produce looseness and slackness during wearing, and is likely to give an uncomfortable feeling to the wearer. On the other hand, when one wears a combination of clothing closely contacted with the body and an outer garment, the contact resistance between the fabrics becomes a major factor that hinders the body movement. The knitted fabric for clothing closely contacted with the body when used is preferred to be excellent in surface smoothness. Accordingly, warp knitted fabrics are most suitable for the purpose of obtaining the effects of the present invention.

The warp knitted fabrics in the present invention include knitted fabrics formed with a tricot knitting machine such as half tricot, back half, double dembigh and two-way tricot, and knitted fabrics formed with a Raschel knitting machine such as satin net, tricot net, tulle and lace. In order to effectively obtain the stretchability, fitting, and the like, of a warp knitted fabric to be formed, a half tricot stitch is preferred. The warp knitted fabric of the present invention has a knitting density prepared with, for example, a knitting machine with a gauge of from 8 to 40 needles per 2.54 cm. Moreover, in order to attain the fullness of the knitted fabric in the present invention, a gauge of from 12 to 36 needles per 2.54 cm is preferred, and a gauge of from 24 to 36 needles is more preferred.

The warp knitted fabric of the present invention shows a stretchability of 60% or more in both the warp and weft directions. The stretchability is measured in accordance with JIS-L-1080 (Constant Rate Elongation Method). A knitted fabric sample 5 cm wide is elongated at a pulling rate of 300% per minute based on the grip-to-grip distance prior to elongation until a load of 44.1 N is applied thereto. The stretchability is represented by a percentage of the grip-to-grip distance after elongation based on the grip-to-grip distance prior to elongation. A load of 44.1 N applied to the knitted fabric sample 5 cm wide herein is a maximum load applied to a knitted fabric when a wearer wears or removes clothing to elongate the fabric.

When a wearer wears clothing showing a stretchability of less than 60% in the weft direction, the article is elongated in its transverse direction during wearing or undressing, the clothing shows poor wearing and undressing properties. Moreover, when a wearer makes various movements while the wearer wears the clothing, the clothing is elongated more in the longitudinal direction than in the transverse direction in portions such as arm, armpit, waist, hip, elbow and knee portions. Because the maximum elongation of the skin of the human body is about 60% when during movement, clothing for which a knitted fabric showing a stretchability of less than 60% in the warp direction is used is uncomfortable during wearing and undressing and is low in adaptability to body movement. It can be concluded from the above that the warp knitted fabric must have a stretchability of 60% or more in both the warp and weft directions.

Furthermore, because a knitted fabric having stretchability is often used in a state where it is elongated in the warp and/or weft direction by about 20%, it is preferred for the knitted fabric to have a stretchability of 80% or more in at least one of the warp and weft directions. Moreover, it is more preferred for the knitted fabric to have a stretchability of 80% or more in both the warp and weft directions. On the other hand, when the stretchability exceeds 200%, the knitted fabric shows a pile-like effect on the surface, a crepe-like effect, and a poor surface smoothness. The stretchability of the knitted fabric is therefore preferably 200% or less, more preferably 160% or less.

Furthermore, the ratio of a stretchability in the weft direction to a stretchability in the warp direction is preferably from 0.5 or more to 2.0 or less, more preferably from 0.7 or more to 1.7 or less, and still more preferably from 1.0 or more to 1.5 or less. When a wearer wears clothing showing a large stretch ratio and closely contacted with the body, stress applied to the knitted fabric depends on the direction. As a result, the clothing tends to rise up or slide down to give the wearer an uncomfortable feeling. It is therefore preferred that the knitted fabric shows stretchability balanced in the warp and weft directions.

The warp knitted fabric of the present invention shows a residual strain at 60% elongation recovery of 15% or less in both the warp and weft directions. The residual strain at 60% elongation recovery is measured in accordance with JIS-L-1080 (Constant Rate Elongation Method). A knitted fabric sample is elongated at a pulling rate of 300%/min based on the grip-to-grip distance of the knitted fabric sample until the elongation reaches 60%. The sample is then readily allowed to recover, and the residual strain is the resultant strain length represented by a percentage based on the initial grip-to-grip distance.

In order to obtain a high stretchability of a knitted fabric, the stretchability can be arbitrarily set by a procedure of slackening the knitting texture forming the knitted fabric. As the stretchability is increased, the density of the fabric is decreased, and the elongation recovery is lowered to increase a residual strain. However, for actual clothing, the residual strain becomes a drawback. For example, when the residual strain is larger than 15% during wearing and undressing, slackness tends to be produced when a wearer wears the clothing. Moreover, when the residual strain is larger than 15%, shape changes of the clothing such as wrinkles, slackness, slackened elbow portions and slackened knee portions tend to be produced after wearing. Accordingly, the residual strain immediately after elongation recovery of the knitted fabric must be 15% or less in both the warp and weft directions. The residual strain is preferably 10% or less, and more preferably 7% or less. Furthermore, there are substantially no fabrics at present that show a residual strain lower than 0%. When fabrics show a residual strain lower than 0%, the effect of tightening the wearer's body is increased during wearing the clothing, and the clothing gives the wearer a tight feeling. Accordingly, the residual strain is preferably 0% or more.

The warp knitted fabric of the present invention comprises a latent crimp fiber.

The latent crimp fiber in the present invention is a synthetic fiber formed from at least two types of polymer components (specifically, the at least two types of polymer components are often bonded in a side-by-side manner or eccentric core-sheath manner), and crimp is developed by heat treatment.

In order to obtain high stretchability and excellent stretching back properties in both the warp and weft directions, the blending ratio of a latent crimp fiber in the warp knitted fabric of the present invention is preferably 10% by weight or more, more preferably 25% by weight or more, and still more preferably 35% by weight or more based on the knitted fabric. When the blending ratio is 10% by weight or more, a warp knitted fabric showing an excellent stretchability and a suitable residual strain is obtained. On the other hand, a warp knitted fabric formed from a latent crimp fiber alone, namely, a warp knitted fabric formed therefrom with a blending ratio of 100% by weight based on the knitted fabric also shows excellent stretchability. A warp knitted fabric formed from 100% by weight of a latent crimp fiber sufficiently satisfies the stretchability and the residual strain. However, in order to increase resistance to pilling and snagging, and surface smoothness of the knitted fabric that clothing is required to have, the blending ratio of a latent crimp fiber is preferably 80% by weight or less based on the knitted fabric. Accordingly, a more preferred blending ratio of a latent crimp fiber is from 25% by weight or more to 80% by weight or less, more preferably from 35% by weight or more to 80% by weight or less, and particularly preferably from 40% by weight or more to 60% by weight or less based on the knitted fabric.

The initial tensile resistance of a latent crimp fiber in the present invention is preferably from 10 to 30 cN/dtex, more preferably from 20 to 30 cN/dtex, and still more preferably from 20 to 27 cN/dtex. When the initial tensile resistance is in the above range, the fiber can be easily produced. Moreover, the knitted fabric is of high grade, and the single filaments of the fiber are hardly entangled. As a result, a dense knitted fabric can be formed.

Furthermore, the stretch elongation of a crimp of a latent crimp fiber is preferably from 10 to 100%, more preferably from 10 to 80%, and still more preferably from 10 to 60%. When the stretch elongation is in the above range, a knitted fabric having a stretchability of 60% or more is easily formed, and the fiber is also easily produced.

Still furthermore, the stretch modulus of a crimp is preferably from 80 to 100%, more preferably from 85 to 100%, and still more preferably from 85 to 97%. When the stretch modulus is in the above range, a knitted fabric having excellent stretching back properties is obtained. In addition, in view of the measurement principle, the latent crimp fiber never shows a stretch modulus exceeding 100%.

Furthermore, the thermal shrinkage stress at 100° C. is preferably from 0.1 to 0.5 cN/dtex, more preferably from 0.1 to 0.4 cN/dtex, and still more preferably from 0.1 to 0.3 cN/dtex. The thermal shrinkage stress at 100° C. is an important necessary condition of developing crimp in the scouring and dyeing stages of the knitted fabric. That is, in order to develop crimp by overcoming the restraining force of the knitted fabric, the thermal shrinkage stress at 100° C. is preferably 0.1 cN/dtex or more. A knitted fabric for which a composite yarn showing a thermal shrinkage stress of less than 0.1 cN/dtex is used tends not to show a sufficient dense feel and adequate stretchability. Moreover, production of a composite yarn showing a thermal shrinkage at 100° C. exceeding 0.5 cN/dtex is difficult, and at the same time the knitted fabric is likely to produce irregularity of surface appearance.

Furthermore, the stretch elongation after boil-off treatment is preferably from 100 to 250%, more preferably from 150 to 250%, and still more preferably from 180 to 250%. In addition, production of a fiber that shows a stretch elongation exceeding 250% is difficult.

The stretch modulus after boil-off treatment is preferably from 90 to 100%, and more preferably from 95 to 100%.

Multifilaments formed from single filaments in which two types of polyesters differing from each other in intrinsic viscosity are composited together in a side-by-side manner are preferred as a latent crimp fiber having such properties. As exemplified in Japanese Examined Patent Publication (Kokoku) No. 43-19108, Japanese Unexamined Patent Publication (Kokai) No. 11-189923, Japanese Unexamined Patent Publication (Kokai) No. 2000-239927, Japanese Unexamined Patent Publication (Kokai) No. 2000-256918, etc., there are side-by-side type multifilaments wherein a first component of poly(trimethylene terephthalate) and a second component of a polyester such as poly(trimethylene terephthalate), poly(ethylene terephthalate) or poly(butylene terephthalate), or nylon are arranged in parallel or eccentrically, and a composite is spun in a side-by-side manner or an eccentric core-sheath manner.

In the present invention, it is preferred that the latent crimp fiber be formed from two types of polyesters, and at least one of the polyesters be poly(trimethylene terephthalate). Moreover, it is preferred that the two types of polyesters be composited in a side-by-side manner or eccentric core-sheath manner.

In addition, a warp knitted fabric that satisfies the conditions of the present invention is hardly obtained from multifilaments that are formed from only one type of polyester such as poly(trimethylene terephthalate), poly(ethylene terephthalate) or poly(butylene terephthalate) and are not a composite fiber, or from a composite fiber in which poly (trimethylene terephthalate) is not used for at least one of the two types of polyesters. The warp knitted fabric is hardly obtained for reasons explained below. A warp knitted fabric that satisfies the conditions of the present invention and has excellent stretchability, stretch recovery, denseness, smoothness and shape retention is easily obtained by utilizing poly(trimethylene terephthalate) having the properties of high elastic recovery force and flexibility as one component of the composite fiber.

In the present invention, the difference in intrinsic viscosity of the two types of polyesters is preferably from 0.05 to 0.7 dl/g, more preferably from 0.05 to 0.5 dl/g, still more preferably from 0.1 to 0.4 dl/g, and particularly preferably from 0.15 to 0.3 dl/g. When the difference in intrinsic viscosity is in the above range, yarn bending and contamination of a spinneret during extrusion from the spinneret in the spinning step seldom take place, and stabilized production of the composite yarn becomes possible. Moreover, a fluctuation in the yarn size is small, and unevenness of tensile properties and uneven dyeing hardly occur. In particular, a composite fiber formed by compositing in a side-by-side manner two types of poly(trimethylene terephthalates) having a difference in intrinsic viscosity of from 0.05 to 0.3 dl/g is particularly preferred. Furthermore, when the intrinsic viscosity on the high viscosity side is selected from the range of 0.7 to 1.5 dl/g, the intrinsic viscosity on the low viscosity side is preferably selected from the range of 0.5 to 1.3 dl/g. In addition, the intrinsic viscosity on the low viscosity side is preferably 0.5 dl/g or more, more preferably from 0.6 to 1.0 dl/g, and still more preferably from 0.7 to 1.0 dl/g.

In the present invention, the average intrinsic viscosity of the composite fiber is preferably from 0.7 to 1.4 dl/g, more preferably from 0.8 to 1.2 dl/g, still more preferably from 0.85 to 1.15 dl/g, and particularly preferably from 0.9 to 1.1 dl/g for the purpose of maintaining the mechanical strength.

In addition, the intrinsic viscosity value in the present invention is not the intrinsic viscosity of a raw material polymer, but it designates the intrinsic viscosity of a spun yarn obtained for the following reasons. A poly(trimethylene terephthalate) is liable to be thermally decomposed in comparison with a poly(ethylene terephthalate), or the like. Even when a polymer having a high intrinsic viscosity is used, the polymer is thermally decomposed in the spinning stage to lower the intrinsic viscosity, and the composite fiber thus obtained cannot maintain the intrinsic viscosity difference between the raw material polymers without any change.

Although there is no specific limitation on the composite ratio of the two types of polyesters differing from each other in intrinsic viscosity, the ratio is preferably from 70/30 to 30/70 in order to obtain the stretch elongation and stretch modulus of the crimp explained above. Moreover, the cross-sectional shape of the single filaments formed by compositing in a side-by-side manner is satisfactory as long as they are substantially formed eccentrically. They are not required to be composited in a complete side-by-side manner. The bonded surface of the cross section of the single filaments may be curved, and the single filaments may be bonded in an eccentric core-sheath manner.

In the present invention, the poly(trimethylene terephthalate) is a polyester having trimethylene terephthalate units as principal repeating units, and contains trimethylene terephthalate units in an amount of 50% by mole or more, preferably 70% by mole or more, more preferably 80% by mole or more, and still more preferably 90% by mole or more. Accordingly, the poly(trimethylene terephthalate) includes a poly(trimethylene terephthalate) containing as third components other acid components and/or glycol components in a total amount of about 50% by mole or less, preferably 30% by mole or less, more preferably 20% by mole or less, and still more preferably 10% by mole or less.

A poly(trimethylene terephthalate) is synthesized by combining terephthalic acid, or a functional derivative thereof, and trimethylene glycol, or a functional derivative of trimethylene glycol, under suitable reaction conditions in the presence of a catalyst. In the course of the synthesis, a suitable one, or two or more third components may be added to give a copolymerized polyester. Alternatively, a poly (trimethylene terephthalate), and a polyester other than a poly(trimethylene terephthalate) such as a poly(ethylene terephthalate) and poly(butylene terephthalate) or nylon may be blended.

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodium sulfoisophthalic acid, aliphatic glycols such as ethylene glycol, 1,2-propylene glycol and tetramethylene glycol, alicyclic glycols such as cyclohexanedimethanol, aliphatic glycols containing an aromatic group such as 1,4-bis(β-hydroxyethoxy) benzene, polyether glycols such as poly(ethylene glycol) and poly(propylene glycol), aliphatic oxycarboxylic acids such as ω-oxycaproic acid, and aromatic oxycarboxylic acids such as p-oxybenzoic acid. Moreover, a compound (such as benzoic acid or glycerin) having one or three or more ester-forming functional groups may also be used as long as the resultant polymer is substantially linear.

Furthermore, the poly(trimethylene terephthalate) may contain delustering agents such as titanium dioxide, stabilizing agents such as phosphoric acid, ultraviolet ray absorbers such as a hydroxybenzophenone derivative, crystallizing nucleus agents such as talc, lubricants such as Aerosil, antioxidants such as a hindered phenol derivative, flame retardants, antistatic agents, pigments, fluorescent brighteners, infrared ray absorbers, defoaming agents, and the like.

In the present invention, any of the methods of spinning a latent crimp fiber disclosed in the above patent publications can be adopted. A preferred method is, for example, a method wherein an undrawn yarn is wound at a rate of 3,000 m/min or less, and drawing and twisting the undrawn yarn by a draw ratio of from about 2 to 3.5. Moreover, the direct drawing method (spin draw method) in which a spinning step and a drawing and twisting step are directly connected, and a high speed spinning method (spin take-up method) in which the winding rate is 5,000 m/min or more may also be adopted.

Furthermore, the shape of the poly(trimethylene terephthalate) fiber may be either a filaments yarn or a staple fiber. The yarn may be uniform, or not uniform, such as thick and thin, in the longitudinal direction. Moreover, the cross section of the filament may be round-shaped, triangle-shaped, L-shaped, T-shaped, Y-shaped, W-shaped, eight leaf-shaped, flat (a flatness of from about 1.3 to 4, e.g., W-shaped, I-shaped, boomerang-shaped, wave-shaped, skewered dumpling-shaped, cocoon-shaped, rectangular parallelepiped-shaped, etc.), polygonal (e.g., dog bone-shaped), multi-leaf-shaped, hollow or indefinitely shaped.

In order to improve the stretchability of a warp knitted fabric in the present invention, the shape of the fiber is preferably a filament yarn. Moreover, in order to suppress the entanglement of single filaments of a latent crimp fiber on a warp knitting machine and improve the warp grade, the cross sectional shape of single filaments is preferably as follows. The flatness of a single filament cross section is from about 1.0 to 1.2. The flatness herein designates a numerical value representing a ratio of a major axis to a minor axis on a single filament cross section obtained by cutting a single filament in the direction vertical to the longitudinal direction thereof. When the flatness is closer to 1, the shape is closer to a circle. On the other hand, when the numerical value is larger, the shape is more flat.

Furthermore, in order to improve the knittability by suppressing the entanglement of single filaments on a warp knitting machine, and improve the warp grade, the latent crimp fiber is preferably subjected to interlace treatment mingling. However, when the number of interlacings is excessive, a soft feeling of the multifilaments is impaired, and development of crimp is suppressed to lower the stretchability. A preferred number of interlacings per meter is from 2 to 100, more preferably from 5 to 80, and still more preferably from 10 to 50. The number of interlacings herein is measured in accordance with JIS-L-1013.

There is no specific limitation on the method of interlacing when the method is carried out prior to knitting. However, in view of the production cost and stability of the number of interlacings, there are a method of imparting interlacing in the spinning stage, and a method thereof in a yarn texturing stage such as false twisting and combining. Interlacing can be imparted at any one of the stages from the starting one to the final winding one in any of the methods.

For example, when interlacing is to be imparted at the spinning stage, interlacing is imparted directly before winding into a package. That is, interlacing can be imparted with, for example, a known interlacing nozzle (interlacer) at the drawing and twisting stage when an undrawn yarn is to be drawn and twisted, or directly before winding a spun yarn when a direct drawing method or a high speed spinning method is employed. Imparting interlacing at the spinning stage has an advantage of reducing the production cost. On the other hand, imparting interlacing at the yarn texturing stage has an advantage of increasing a number of interlacings in comparison with imparting interlacing at the spinning stage. Interlacing may naturally be imparted at both the spinning stage and the yarn texturing stage.

Examples of the shape of the yarn of a latent crimp fiber include a soft or hard twisted yarn, a combined filaments yarn, a false-twisted yarn (including a drawn and false-twisted yarn of POY), an air-jet textured yarn, a stuffing-box crimped yarn, a knit-deknit textured yarn, a spun yarn such as a ring spun yarn and an open end spun yarn and a multifilaments raw yarn (including an extremely thin yarn). Of these, a raw yarn and a false-twisted yarn are preferred. Moreover, the latent crimp fiber may be blended with a natural fiber represented by wool, or other fibers by means such as stable fiber blending (CSIRO spun, CSIRO fil, etc.), filament intermingling and combining (a different shrinkage combined filaments yarn prepared with a high shrinkage yarn, etc.), twisted combination, composite false twisting (elongation-differenced false twisting, etc.) and fluid-jet texturing with two feeds.

There is no specific limitation on the total size of a latent crimp fiber used in the present invention as long as the object of the present invention is not impaired and the fiber can be used for clothing. However, in view of the knittability and ease of handling of current knitting machines, the total size is preferably from 5 to 500 dtex, more preferably from 10 to 300 dtex, and still more preferably from 20 to 100 dtex. The single filament size is preferably from 0.5 to 20 dtex, and more preferably from about 1 to 10 dtex. When the single filament size is in the above range, a knitted fabric formed from the yarn is excellent in surface smoothness and aesthetic appearance, shows good stretchability and elongation recovery, and has a soft feeling and soft touch to the skin.

The physical properties of a raw yarn for a latent crimp fiber used in the present invention are explained below. The strength is preferably from 1.5 to 10 cN/dtex, and more preferably from 2.0 to 6.0 cN/dtex. The elongation is preferably from 10 to 100%, and more preferably from 25 to 50%. When the strength is less than 1.5 cN/dtex, a burst strength and a tear strength of the knitted fabric necessary for clothing are not maintained. The burst strength (measured in accordance with JIS-L-1018 (Mullen method)) of a knitted fabric necessary for clothing is preferably 300 kPa or more, and more preferably 500 kPa or more. The tear strength (measured in accordance with JIS-L-1018 (pendulum method)) is preferably 7 N or more, more preferably 10 N or more. When the elongation is less than 10%, yarn breakage tends to occur during knitting a warp knitted fabric. In order to obtain a high stretchability of a warp knitted fabric, the elongation is still more preferably from 25 to 50%.

Furthermore, a preferred embodiment of the latent crimp fiber is preferably a yarn showing a decreased residual torque. When a yarn showing a decreased residual torque is used for a warp knitted fabric, skew is likely to take place in the knitted fabric, and the loop shape thereof tends to become disordered to cause a stitch shift. As a result, the grade thereof tends to fall. The number of torque is preferably 100 T/m or less, more preferably 50 T/m or less, and still more preferably 20 T/m or less. In addition, the number of torque herein is obtained by attaching a load of 0.1 g/dtex to the yarn, and measuring a number of rotations of the load.

Furthermore, a preferred embodiment of the latent crimp fiber is preferably a yarn having a decreased bulkiness. Because the latent crimp fiber is highly capable of manifesting crimp, for a knitted fabric formed from a yarn with high bulkiness, crimps tend to float thereon, and a resistance to pilling and snagging is sometimes decreased. A yarn having decreased bulkiness is therefore preferred as a latent crimp fiber. Specifically, formation of a knitted fabric from a raw yarn to which bulkiness is not imparted is preferred. Moreover, a raw yarn of the latent crimp fiber is preferred to show decreases in both residual torque and bulkiness in order to obtain a knitted fabric of an excellent grade having gloss and surface smoothness.

The warp knitted fabric of the present invention is formed from a latent crimp fiber and a non-latent crimp fiber, and is preferably prepared by mixed knitting of both of the fibers.

The non-latent crimp fiber may be a fiber that is other than an elastic fiber and that has no latent crimpability. For example, the following fibers can be used: synthetic fibers such as polyester-based fibers, polyamide-based fibers, polyacrylonitrile-based fibers, polyvinyl-based fibers and polypropylene-based fibers; natural fibers such as cotton, wool, hemp and silk; artificial cellulose fibers such as cuprammonium rayon, rayon, acetate, polynosic rayon and Lyocell.

Of these fibers, polyester-based and/or polyamide-based synthetic fibers are preferred. Because polyester-based and polyamide-based synthetic fibers are significantly thermoplastic, and have relatively high resistance to various physical and chemical actions, the warp knitted fabrics obtained therefrom show improved denseness, stretchability and resistance to pilling and snagging. In addition, the polyester-based synthetic fibers herein include fibers having as the major components fiber-formable polyester polymers such as poly(ethylene terephthalate), poly(butylene terephthalate) and poly(trimethylene terephthalate). Moreover, polyamide-based synthetic fibers include fibers having as the major components fiber-formable polyamide polymers such as nylon 6, nylon 66 and nylon 612.

The shape of the yarns may be either raw yarns or textured yarns such as twisted yarns, false-twisted yarns and air-textured yarns. For example, a raw yarn is used when a knitted fabric is desired to have a glossy and smooth surface grade, and a false-twisted yarn is used when a knitted fabric is desired to have stretchability and bulkiness. Suitable procedures can thus optionally be selected according to the object. In order to obtain a softer knitted fabric, a flat multifilamentary yarn with a lowered single filament size, or a poly(trimethylene terephthalate) fiber raw yarn with a low fiber Young's modulus can also be used. In particular, a filaments flat yarn is more preferred because the resultant knitted fabric hardly becomes bulky, and shows improved denseness, stretchability, and resistance to pilling and snagging.

A preferred knitting method in the present invention is a method comprising using a knitting stitch having a structure wherein a non-latent crimp fiber is arranged in the knitted fabric surface layer, and a latent crimp fiber is arranged in the knitted fabric inner layer. In particular, a warp knitted fabric with a stitch that is composed of a closed lap and/or an open lap, prepared by the following procedure is preferred: a non-latent crimp fiber is drawn in a front guide bar and a latent crimp fiber is drawn in a back guide bar of a warp knitting machine having a single needle bed; and knitting is conducted with at least two-bar knitted stitch. Typical stitches of the warp knitted fabric include double dembigh, double cord, half stitch (rock knit), back half stitch, queen's cord, satin and double atlas, though the typical stitches are not restricted to those mentioned above. Because the fullness, feel, gloss and stretchability of a knitted fabric greatly change depending on the stitches, they may be selected in view of the application and necessary function of the knitted fabric. For example, when a light gauged knitted fabric is required, the underlapping of a front and/or back stitch is made two stitches or less. When a thick fabric and a relatively small stretchability are desired, the underlapping of a front and/or back stitch is made larger than two stitches. Examples of the knitting stitches wherein the warp knitted fabric shows a relatively high stretchability and a relatively small residual strain include satin and a half tricot stitch. Of the knitting stitches, a half tricot stitch is preferred.

Although preferred knitting stitches are exemplified below, they are not restricted to those mentioned below.

(1) Front guide bar two stitch structure, knitted fabric that is a so-called half tricot stitch Front: 10/23, back: 12/10

(2) Half tricot stitch that shifts a positional relationship between a front stitch and a back stitch Front: 10/23, back: 10/12

(3) Half tricot stitch in which a combination of an open lap and a closed lap is changed Front: 10/23, back: 21/01

The warp knitted fabric of the present invention preferably has a fullness ($L_W$CF) in wale direction of from 500 or more to 1,500 or less. The fullness ($L_W$CF) herein is given by the following formula that is a function of a number of knitted loops (number of wales) per 2.54 cm width in the wale direction of the knitted fabric, and a total size of a yarn forming the loops:

$$(L_W CF)=(\text{number of wales})\times\{\text{total size } (dtex) \text{ of yarn}\}^{1/2}$$

When the knitted fabric is formed with a plurality of bars, a structure in which a plurality of yarns are integrated in a single loop is formed. As a result, the total size of yarn is a total sum of the size of a plurality of yarns. For example, when knitting is conducted by arranging a yarn with 56 decitex at a front guide bar and a yarn with 44 decitex at a back guide bar, the total size of the yarns becomes 100 dtex.

When the fullness ($L_W$CF) is 500 or more in the wale direction, the warp knitted fabric has a suitable density, shows excellent denseness and surface smoothness, and can hardly be seen through. On the other hand, when the fullness ($L_W$CF) is 1,500 or less, the knitted fabric can be easily produced, and shows excellent denseness; the knitted loops of yarns forming the knitted fabric hardly floats, and the knitted fabric shows excellent resistance to pilling and snagging. Accordingly, a warp knitted fabric having denseness and surface smoothness, and satisfying see-through prevention, resistance to pilling, and resistance to snagging shows a fullness ($L_W$CF) of preferably from 500 or more to 1,500 or less, more preferably from 500 or more to 1,000 or less, and still more preferably from 500 or more to 800 or less.

Furthermore, the warp knitted fabric of the present invention has a ratio of the knitted fabric density (number of wales/number of courses) in the wale direction to that in the course direction of preferably from 0.6 or more to 1.0 or less. The ratio of the knitted fabric density herein designates the density ratio of the knitted fabric after dye finishing. When the knitted fabric is to be prepared, it must be designed while the shrinkage of yarns forming the knitted fabric is being taken into consideration. The ratio of the knitted fabric density refers to a value obtained by dividing a number of loops (number of wales) per 2.54 cm space in the weft (wale) direction thereof by a number of loops (number of courses) per 2.54 cm space in the warp (course) direction thereof. When the ratio of the knitted fabric density is in the above range, a warp knitted fabric excellent in stretchability is obtained. Moreover, a balance between a stretchability of the knitted fabric in the warp direction and a stretchability thereof in the weft direction is excellent, and fine crimps and shifts of stitches on the knitted fabric surface are hardly formed; the surface smoothness of the knitted fabric, resistance to pilling and resistance to snagging are also excellent. Accordingly, the ratio of the knitted fabric density (number of wales/number of courses) in the wale direction to that in the course direction is preferably from 0.6 or more to 1.0 or less, more preferably from 0.65 or more to 0.95 or less, and still more preferably from 0.7 or more to 0.9 or less.

Furthermore, a warp knitted fabric showing both pilling grade (measured in accordance with JIS-L-1076 A) and snagging grade (measured in accordance with JIS-L-1076 D-3) of the $2^{nd}$ class or more, particularly the $3^{rd}$ class or more can be obtained in the present invention.

Next, a preferred method of producing a warp knitted fabric of the present invention will be explained.

The knitting design of a warp knitted fabric in the present invention is fundamentally carried out by taking a yarn length shrinkage of a yarn used and a structure shrinkage of the knitted fabric in dye finishing into consideration, and adjusting a runner length (also referred to as run in, an index showing the length of a yarn forming one stitch, a larger numerical value for the same structure indicating that the stitches are coarser, representing a yarn length per 480 courses in the field of knitted fabrics) and an on-machine course (an index showing the height of one stitch during knitting, the knitted fabric having a higher density when a number of courses that is a winding amount of the knitted fabric is larger).

Latent crimp fibers function as a stretch component of a knitted fabric. A runner length must therefore be increased, in comparison with a case where non-latent crimp fibers are used, so that the crimp of the latent crimp fiber is developed in the knitted fabric. Moreover, the knitted fabric must be formed while the on-machine course of the knitted fabric is being made coarse so that crimp of latent crimp fibers is developed in the knitted fabric to further function sufficiently as a stretch component thereof.

Preferred ranges of the runner length and on-machine course are hardly exemplified because the preferred ranges greatly differ depending on the structure to be knitted and the size of yarns, and the gauge of a knitting machine. However, knitting was conducted with a half tricot stitch under the following conditions: a 28-gauge tricot knitting machine is used; a poly(ethylene terephthalate) fiber with 56 dtex is arranged at a front guide bar as a non-latent crimp fiber; and a composite fiber with 56 dtex composed of poly (trimethylene terephthalates) differing from each other in intrinsic viscosity is arranged at a back guide bar as a latent crimp fiber. A preferred on-machine course is then from 45 to 65 courses/2.5 cm; a preferred runner length is from 120 to 170 cm/480 courses at a back guide bar, and, at a front guide bar, from 1.0 to 1.3 times, most suitably from 1.05 to 1.25 times the runner length at a back guide bar.

The warp knitted fabric of the invention can be subjected to scouring, heat setting, dyeing, and the like processing by known methods. There is no specific limitation on the methods and conditions of the post treatments. Fabric dyeing such as roll dyeing or circular dyeing, piece dyeing, product dyeing or the like can be adopted. For example, when the warp knitted fabric is to be roll dyed, the roll dyeing methods include the following: (1) the gray fabric is scoured, dyed, and finish set; (2) the gray fabric is scoured, preset, dyed, and finish set; and (3) the gray fabric is preset, then scoured, dyed, and preset. Because crimp is developed with heat and stretchability is imparted to the knitted fabric when a latent crimp fiber is used, the gray fabric is preferably scoured at first. A more preferred method is the one mentioned in (1). In order to effectively develop a crimp of a latent crimp fiber, the scouring temperature is preferably from 60 to 120° C., and more preferably from 75 to 100° C. Because the feeling of a latent crimp fiber is changed by the heat treatment of presetting and finish setting, the heat treatment temperature of presetting and finish setting is preferably from 140 to 180° C., and more preferably from 150 to 170° C. When the heat treatment temperature is in this range, the knitted fabric gives a soft feeling, has an excellent touch, and shows excellent stretchability.

The warp knitted fabric of the present invention may be dyed by a common method of dyeing knitted fabrics with a known dye such as an acidic dye, a dispersion dye, a cationic dye and a direct dye. The dyeing temperature is preferably from 90 to 135° C., and the dyeing time is preferably from 15 to 120 minutes after heating. Moreover, because the crimp of the latent crimp fiber is gradually developed during the heating stage, the heating time is preferably set longer. For example, heating is controlled at temperature from 40 to 60° C., and the temperature is raised to a predetermined dyeing temperature at a rate of generally from 1 to 10° C./min, preferably from 1 to 5° C./min, and more preferably from 1 to 3° C./min. In order to develop a uniform crimp, the above procedure is preferred. Furthermore, when the dyeing solution is wasted immediately after dyeing during the cooling stage, the knitted fabric is drastically cooled to cause wrinkles and unevenness on the fabric. Accordingly, the knitted fabric is gradually cooled, for example, to a temperature of 60 to 80° C. at a rate of from 2 to 10° C./min, preferably from 3 to 5° C./min.

During fabric dyeing such as roll dyeing or circular dyeing, use of a liquid-jet dyeing machine or an air-jet dyeing machine in which a tension is hardly applied to the warp knitted fabric in the warp direction is preferred because the stretchability in the warp direction thereof is improved. Moreover, in piece dyeing or article dyeing, an obermaier, a paddle dyeing machine, a drum dyeing machine or the like may be used. The stretchability in the warp direction of the knitted fabric can then be increased in comparison with roll dyeing because a tension is hardly applied to the knitted fabric in the warp direction.

During finish setting, the warp knitted fabric of the invention can be subjected to ordinary fiber processing, for example, finish setting such as resin finishing, water absorption treatment, antistatic treatment, antibacterial treatment and water-repellent treatment. In particular, application to the warp knitted fabric of a treatment agent having the effect of decreasing frictional resistance among yarns forming the knitted fabric is preferred in the present invention because the residual strain at 60% elongation recovery can be decreased. Treatment agents having a high affinity to fibers forming the knitted fabric are preferred. When the treatment agents have low affinity, they sometimes fall off during wear to lower the stretchability of the fabric. The treatment agents are preferred to have smoothness, durability and resistance to washing. In particular, silicone-based compounds are preferred as compounds having the above properties. Moreover, amino-modified silicone, carboxyl-modified silicone and epoxy-modified silicone are more preferred. Adhesion amount of a silicone compound is preferably from 0.05 to 5.0% by weight, and more preferably from 0.1 to 3.0% by weight based on the knitted fabric. When the adhesion amount is excessive, and exceeds 5.0% by weight, a greasy feeling and a slippery feeling of the silicone on the knitted fabric are stressed, and slip-off of a sewing yarn subsequent to sewing the knitted fabric or a puncture caused by slide-off of a yarn in the sewed portion tends to take place. It is therefore preferred to ascertain a proper amount of the silicone compound and to allow it to adhere to the fabric.

Examples of the treating machine used for finish setting include a pin tenter, a clip tenter, a short loop drier, a shrink surfer drier, a drum drier and a continuous or batch type tumbler. These treating machines may also be used in combination.

Because the warp knitted fabric of the present invention gives articles excellent in the ease of wearing and removal and in adaptability to the body movement, the warp knitted fabric is most suitable for clothing closely contacted with the body, particularly for swimwear required to show significant elongation recovery in water where the clothing suffers a large resisting force. Moreover, the warp knitted fabric is appropriate to shirts, pants and spats closely contacted with the body, particularly appropriate to sports undershirts and underpants. Furthermore, the warp knitted fabric is suitable for underwear that is closely contacted with the body and is aimed at keeping the body silhouette as girdles, pants, undergarments, brassieres, bodysuits and foundation garments. Still furthermore, the warp knitted fabric is also appropriate to stretch bottoms of outerwear.

BEST MODE FOR CARRYING OUT THE INVENTION

The present invention will be further explained below by making reference to examples. However, the present invention is in no way restricted thereto.

In addition, the measurement methods, evaluation methods, knitting conditions of the warp knitted fabrics, and dye finishing conditions and the like of the warp knitted fabrics are as explained below.

(1) Intrinsic Viscosity

The intrinsic viscosity [η] (dl/g) is a value determined on the basis of a definition of the following formula:

$$[\eta] = \lim_{C \to 0} (\eta_r - 1)/C$$

wherein $\eta_r$ is a value obtained by dividing a viscosity of a diluted solution, at 35° C. and that is derived by dissolving a poly(trimethylene terephthalate) yarn or a poly(ethylene terephthalate) yarn in an o-chlorophenol solvent having a purity of 98% or more, by the viscosity of the above solvent that is measured at the same temperature, and is defined as a relative viscosity, and C is a polymer concentration in terms of g/100 ml.

In addition, for a composite fiber formed from two types of polymers differing from each other in intrinsic viscosity, measurement of the intrinsic viscosity of each polymer forming the filaments is difficult. The two types of polymers are therefore each spun singly under the conditions under which the composite fiber has been spun. The intrinsic viscosity determined using each yarn thus obtained is defined as the intrinsic viscosity of the polymer forming the composite fiber.

(2) Evaluation of Yarn Breakage during Knitting warp Knitted Fabric, and Conditions of Dye Finishing A number of yarn breakages per 480 courses is defined as the number of yarn breakages.

The dye finishing conditions are as follows. A warp knitted fabric is subjected to scouring relaxing at 80° C., jet dyed at 130° C., dehydrated, and finished by final heat setting at 160° C. for 30 sec.

(3) Stretchability and Residual Strain

The stretchability is measured in accordance with JIS-L-1080 (Constant Rate Elongation Method), using Tensilon (manufactured by Toyo Baldwin K.K.). A knitted fabric sample 5 cm wide is elongated at a pulling rate of 300% per minute based on the grip-to-grip distance prior to elongation until a load of 44.1 N is applied thereto. The stretchability is represented by a percentage of the grip-to-grip distance after elongation based on the grip-to-grip distance prior to elongation.

The residual strain is measured in accordance with JIS-L-1080 (Constant Rate Elongation Method). A knitted fabric is elongated at a pulling rate of 300%/min based on the grip-to-grip distance until the elongation reaches 60%. The sample is then readily allowed to recover, and the residual strain is the resultant strain length represented by a percentage based on the initial grip-to-grip distance.

(4) Fullness ($L_W$CF) in Wale Direction

The fullness is obtained by the following formula that is a function of a number of arranged knitted loops (number of wales) per 2.54 cm width in the wale direction of a knitted fabric, and a total size of a yarn forming the loops:

$$(L_W CF)=(\text{number of wales})\times\{\text{total size } (dtex) \text{ of yarn}\}^{1/2}$$

(5) Ratio of Knitted Fabric Density in Wale Direction to That in Course Direction The ratio is obtained by dividing a number of loops (number of wales) per 2.54 cm space in the weft (wale) direction of a knitted fabric by a number of loops (number of courses) per 2.54 cm space in the warp (course) direction of thereof.

(6) Surface Smoothness of Knitted Fabric

Five panelists evaluate the surface smoothness of a knitted fabric by sensory evaluation according to the following criteria.

○: Surface smoothness being high

Δ: Surface being smooth

X: Surface smoothness being low (7) Denseness of Knitted Fabric

Five panelists evaluate the denseness of a knitted fabric by evaluation of the touch and visual sensation, and the results are classified into 5 ranks. The highest evaluation gains five points, and the lowest evaluation gains one point. The results are judged by the average of the values awarded by the five panelists.

(8) Shape Retention of Knitted Fabric

The stretchability and residual strain of a sample are measured, and the sample is allowed to stand still on a flat table. The shape retention of the sample is evaluated from the curling state of the knitted fabric, and classified into the following three ranks.

○: Shape changing little (curling degree being 0 degrees or more and less than 90 degrees)

Δ: Shape changing to some degree (curling degree being 90 degrees or more and less than 180 degrees)

X: Shape changing greatly (curling degree being 180 degrees or more)

A sample, directly after being elongated by 60%, is allowed to stand still on a flat table for 30 minutes without tension and load, in an atmosphere at 20° C. with its humidity conditioned to an RH of 65%, and the wound-up angle of the edge portion of the sample is measured as the curling degree. A protractor is attached to the wound-up portion of the edge portion, and the angle (θ) made by the tangential line of the tip portion of the edge portion with the horizontal table is determined.

When the curling degree is 90 degrees or more, elongation of the knitted fabric generates a shift of the knitting stitch in the interior of the knitted fabric. When the curling degree is 180 degrees or more, an article prepared from the knitted fabric shows deterioration of the product shape; slackened elbow and knee portions are produced, and the article gives a poor fitting feeling.

(9) Flexibility of Knitted Fabric

Using KES FB2 (trade name, a pure bending test machine, manufactured by Kato Tekku K. K.), the average bending stiffness (B) of a knitted fabric is measured under the conditions shown below, and is used as an index of the flexibility. The bending stiffness in the warp direction and that in the weft direction are each measured. The weighted average value is calculated, and used as the average bending stiffness.

Conditions of Measuring a Bending Stiffness

Maximum curvature: ±2.5 $cm^{-1}$

Curvature increase rate: 0.5 cm/sec

Sample width: 20 cm

Clamp-to-clamp distance (sample length): 1 cm

The bending stiffness herein indicates a stress applied to the fixed portion of the knitted fabric when the knitted fabric is bent to its maximum curvature. The bending stiffness is an index that indicates that the knitted fabric is more hardly bent when the numerical value is higher. It can therefore be said that for the evaluation of the flexibility of a knitted fabric, a knitted fabric showing a lower numerical value of the bending stiffness is more flexible.

(10) Durability of Knitted Fabric (Swimwear)

The resistance to active chlorine of a knitted fabric is evaluated by a model evaluation on assumptive use as swimwear. The stress retention in the model evaluation is classified into 3 ranks, and judged in the following manner.

○: Significantly excellent in resistance (stress retention being from 70% or more to 100% or less)

Δ: Excellent in resistance (stress retention being from 40% or more to less than 70%)

X: Poor in resistance (stress retention being less than 40%)

(11) Durability of Knitted Fabric (Innerwear)

The resistance to sebum and light of a knitted fabric is evaluated by a model evaluation on assumptive use as innerwear. The stress retention in the model evaluation is classified into 3 ranks, and judged in the following manner.

○: Significantly excellent in resistance (stress retention being from 70% or more to 100% or less)

Δ: Excellent in resistance (stress retention being from 40% or more to less than 70%)

X: Poor in resistance (stress retention being less than 40%)

(12) Fitting Feeling Given by Swimwear for Which Knitted Fabric is Used

One-piece swimsuits for women are prepared in the same pattern. Each of the five panelists (women) wore the swimsuit, entered a pool, and evaluated by sensory evaluation the fitting feeling after walking in water for five minutes and swimming for five minutes. The results are classified into five ranks. The highest evaluation gains five points, and the lowest evaluation gains one point. The swimwear is evaluated by the averaged value of the evaluation by the five panelists.

Fibers used in examples and comparative examples are as described below.

<Latent Crimp Fiber>

(a-1) Preparation of a Latent Crimp Fiber Formed from Two Types of Poly(Trimethylene Terephthalates) Differing from Each Other in Intrinsic Viscosity

PREPARATION EXAMPLE 1

Two types of poly(trimethylene terephthalates) differing from each other in intrinsic viscosity was extruded in a ratio of 1:1 in a side-by-side manner, and spun at 265° C. at a spinning rate of 1,500 m/min to give an undrawn yarn. The undrawn yarn was drawn and twisted at a hot roll temperature of 55° C., a hot plate temperature of 140° C., a draw rate of 400 m/min and such a draw ratio that the drawn yarn was to have a size of 56 dtex. The drawn and twisted yarn was further fed to an interlacing nozzle at an air pressure of 30 $N/cm^2$ (3.0 $kg/cm^2$) immediately before winding to give a side-by-side type of latent crimp fiber.

The latent crimp fiber thus obtained showed a size of 56 dtex/24 f, a number of interlacing of 31/m, and an intrinsic viscosity ([η]) of 0.90 on the high viscosity side and 0.70 on the low viscosity side.

PREPARATION EXAMPLE 2

Using two types of poly(trimethylene terephthalates) differing in intrinsic viscosity difference from the poly (trimethylene terephthalates) in Preparation Example 1, a side-by-side type of latent crimp fiber having a size of 56 dtex/24 f was obtained by the same procedure as in Preparation Example 1. The latent crimp fiber thus obtained showed an intrinsic viscosity (η) of 0.86 on the high viscosity side and 0.69 on the low viscosity side.

PREPARATION EXAMPLE 3

Using two types of poly(trimethylene terephthalates) differing in intrinsic viscosity difference from the poly (trimethylene terephthalates) in Preparation Example 1, a side-by-side type of latent crimp fiber having a size of 56 dtex/24 f was obtained by the same procedure as in Preparation Example 1. The latent crimp fiber thus obtained showed an intrinsic viscosity (η) of 1.17 on the high viscosity side and 0.87 on the low viscosity side.

PREPARATION EXAMPLE 4

Using two types of poly(trimethylene terephthalates) differing in intrinsic viscosity difference from the poly (trimethylene terephthalates) in Preparation Example 1, a side-by-side type of latent crimp fiber having a size of 56 dtex/24 f was obtained by the same procedure as in Preparation Example 1. The latent crimp fiber thus obtained showed an intrinsic viscosity (η) of 1.20 on the high viscosity side and 0.72 on the low viscosity side.

The latent crimp fiber showed an intrinsic viscosity difference larger than those of the latent crimp fibers obtained in Preparation Examples 1 to 3, and spinning was stably conducted. However, when the yarn was not subjected to interlace treatment, the yarn showed low cohesiveness, and deteriorated knittability. When the yarn was subjected to interlace treatment, the yarn showed significantly improved knittability. Interlace treatment made the latent crimp fiber show more improved effects of knittability than those shown by the latent crimp fibers obtained in Preparation Examples 1 to 3.

PREPARATION EXAMPLE 5

Using two types of poly(trimethylene terephthalates) differing in intrinsic viscosity difference from the poly (trimethylene terephthalates) in Preparation Example 1, a side-by-side type of latent crimp fiber having a size of 56 dtex/12 f was obtained by the same procedure as in Preparation Example 1. The latent crimp fiber thus obtained showed an intrinsic viscosity (η) of 0.88 on the high viscosity side and 0.70 on the low viscosity side.

PREPARATION EXAMPLE 6

Using two types of poly(trimethylene terephthalates) differing in intrinsic viscosity difference from the poly (trimethylene terephthalates) in Preparation Example 1, a side-by-side type of latent crimp fiber having a size of 56 dtex/24 f was obtained by the same procedure as in Preparation Example 1. The latent crimp fiber thus obtained showed an intrinsic viscosity (η) of 1.40 on the high viscosity side and 0.72 on the low viscosity side.

Because the latent crimp fiber showed an excessively large intrinsic viscosity, the yarn discharged from a spinneret was significantly bent, and stabilized preparation of the yarn was difficult due to frequent yarn breakages during spinning. Furthermore, because yarn breakage often took place in the drawing and twisting stage, the yarn could not be drawn at a proper draw ratio. As a result, the yarn could be drawn and twisted only at a low draw ratio. The yarn thus obtained therefore had a low degree of molecular orientation, and a low crimp and an insufficiently developed crimp of a latent crimp fiber.

PREPARATION EXAMPLE 7

Using two types of poly(trimethylene terephthalates) differing in intrinsic viscosity difference from the poly (trimethylene terephthalates) in Preparation Example 1, a side-by-side type of latent crimp fiber having a size of 56 dtex/24 f was obtained by the same procedure as in Preparation Example 1. The latent crimp fiber thus obtained showed an intrinsic viscosity (η) of 0.90 on the high viscosity side and 0.86 on the low viscosity side.

(A-2) Preparation of Latent Crimp Fiber Formed from Two Types Of Poly(ethylene Terephthalates) Differing from Each Other in Intrinsic Viscosity

PREPARATION EXAMPLE 8

Using Two Types of Poly(ethylene Terephthalates) differing from each other in intrinsic viscosity, a side-by-side type of composite fiber having a size of 56 dtex/24 f was obtained. The composite fiber thus obtained showed an intrinsic viscosity (η) of 0.66 on the high viscosity side and 0.50 on the low viscosity side.

Table 1 shows the fibers obtained in Preparation Examples 1 to 8 explained above.

TABLE 1

| | | (a1) | | | | | | | (a2) |
|---|---|---|---|---|---|---|---|---|---|
| | | Prepn. Ex. 1 | Prepn. Ex. 2 | Prepn. Ex. 3 | Prepn. Ex. 4 | Prepn. Ex. 5 | Prepn. Ex. 6 | Prepn. Ex. 7 | Prepn. Ex. 8 |
| Polymer type | | PTT/PTT | PTT/PTT | PTT/PTT | PTT/PTT | PTT/PTT | PTT/PTT | PTT/PTT | PET/PET |
| Size(dtex)/number of filaments | | 56/24 | 56/24 | 56/24 | 56/24 | 56/12 | 56/24 | 56/24 | 56/24 |
| Intrinsic viscosity difference (dl/g) | | 0.20 | 0.17 | 0.30 | 0.48 | 0.18 | 0.68 | 0.04 | 0.16 |
| Initial tensile resistance (cN/dtex) | | 23 | 22 | 24 | 20 | 23 | 18 | 22 | 21 |
| Crimp | St. eln.*(%) | 24 | 21 | 26 | 20 | 23 | 6 | 7 | 1 |
| | St. mod.+(%) | 90 | 87 | 91 | 86 | 88 | 74 | 98 | 100 |
| After boil-off treatment | St. eln.*(%) | 211 | 190 | 215 | 184 | 195 | 80 | 76 | 72 |
| | St. mod.+(%) | 98 | 98 | 99 | 92 | 98 | 75 | 98 | 95 |
| Thermal shrinkage stress (cN/dtex) | | 0.21 | 0.19 | 0.25 | 0.15 | 0.20 | 0.09 | 0.08 | 0.15 |
| Number of interlacing (pieces/m) | | 31 | 30 | 32 | 35 | 26 | 28 | 40 | 27 |

Note: *St. eln. = Stretch elongation
+mod. = Stretch modulus

<Preparation of Non-Latent Crimp Fiber>

(b-1) Preparation of Non-latent Crimp Poly(trimethylene Terephthalate) Fiber

PREPARATION EXAMPLE 9

A poly(trimethylene terephthalate) having an intrinsic viscosity of 0.8 was spun at 265° C. at a spinning rate of 1,200 m/min to give an undrawn yarn. The undrawn yarn thus obtained was drawn and twisted at a hot roll temperature of 60° C., a hot plate temperature of 140° C., a draw ratio of 3 and a draw rate of 800 m/min to give a drawn yarn having a size of 56 dtex/24 f. The drawn yarn showed a strength of 3.6 cN/dtex, an elongation of 44% and an elastic modulus of 23cN/dtex.

(b-2) Non-latent Crimp Poly(ethylene Terephthalate) Fiber

A commercially available poly(ethylene terephthalate) fiber (multifilaments, manufactured by Asahi Kasei Co., Ltd.) having a size of 56 dtex/24 f was used.

EXAMPLE 1

A non-latent crimp poly(trimethylene terephthalate) fiber obtained in Preparation Example 9 and having a size of 56 dtex/24 f was arranged at a front guide bar, and a latent crimp fiber obtained in Preparation Example 1 was arranged at a back guide bar. A warp knitted fabric having a half tricot stitch was prepared with a 28-gauge tricot knitting machine (tricot knitting machine manufactured by Karl Meyer, type: KS4P) at an on-machine width of 210 cm and a number of rotation of 800 rpm. During the preparation of the warp knitted fabric, the runner length was as follows: 170 cm/480 courses at a front guide bar; and 140 cm/480 courses at a back guide bar.

As a result, yarn breakage took place 0.05 times per 480 courses. Moreover, the blending ratio of the latent crimp fiber was 41% by weight based on the knitted fabric. The knitted fabric was finished under the above dye finishing conditions to give a warp knitted fabric.

EXAMPLE 2

A finished warp knitted fabric was obtained under the same knitting and dyeing conditions as in Example 1 except that the latent crimp fiber obtained in Preparation Example 2 was arranged at a back guide bar in place of the latent crimp fiber obtained in Example 1. The blending ratio of the latent crimp fiber was 40% by weight.

EXAMPLE 3

A finished warp knitted fabric was obtained under the same knitting and dyeing conditions as in Example 1 except that the latent crimp fiber obtained in Preparation Example 3 was arranged at a back guide bar in place of the latent crimp fiber obtained in Preparation Example 1. The blending ratio of the latent crimp fiber was 40% by weight.

EXAMPLE 4

A finished warp knitted fabric was obtained under the same knitting and dyeing conditions as in Example 1 except that the latent crimp fiber obtained in Preparation Example 4 was arranged at a back guide bar in place of the latent crimp fiber obtained in Preparation Example 1. The blending ratio of the latent crimp fiber was 39% by weight.

COMPARATIVE EXAMPLE 1

A finished warp knitted fabric was obtained under the same knitting and dyeing conditions as in Example 1 except that the latent crimp fiber obtained in Preparation Example 6 was arranged at a back guide bar in place of the latent crimp fiber obtained in Example 1. The blending ratio of the latent crimp fiber was 39% by weight.

COMPARATIVE EXAMPLE 2

A finished warp knitted fabric was obtained under the same knitting and dyeing conditions as in Example 1 except that the latent crimp fiber obtained in Preparation Example 7 was arranged at a back guide bar in place of the latent crimp fiber obtained in Preparation Example 1. The blending ratio of the latent crimp fiber was 41% by weight.

EXAMPLE 5

A finished warp knitted fabric was obtained under the same knitting and dyeing conditions as in Example 1 except that the latent crimp fiber obtained in Preparation Example 1 was arranged at a front guide bar in place of the non-latent crimp poly(trimethylene terephthalate). Because latent crimp fibers obtained in Preparation Example 1 were arranged at both a front guide bar and a back guide bar, the blending ratio of the latent crimp fibers was 100% by weight.

EXAMPLE 6

A finished warp knitted fabric was obtained under the same knitting and dyeing conditions as in Example 1 except that a non-latent crimp poly(ethylene terephthalate) fiber having a size of 56 dtex/24 f was arranged at a front guide bar in place of the non-latent crimp poly(trimethylene terephthalate) fiber in Example 1. The blending ratio of the latent crimp fiber was 38% by weight.

EXAMPLE 7

A finished warp knitted fabric was obtained under the same knitting and dyeing conditions as in Example 1 except that a non-latent crimp poly(ethylene terephthalate) fiber having a size of 84 dtex/36 f was arranged at a front guide bar in place of the non-latent crimp poly(ethylene terephthalate) fiber having a size of 56 dtex/24 f in Example 6. The blending ratio of the latent crimp fiber was 27% by weight.

EXAMPLE 8

A finished warp knitted fabric was obtained under the same knitting and dyeing conditions as in Example 1 except that a yarn having a size of 112 dtex/48 f and prepared by doubling two non-latent crimp poly(trimethylene terephthalate) fibers each having a size of 56 dtex/24 f was arranged at a front guide bar in place of the non-latent crimp poly(trimethylene terephthalate) fiber having a size of 56 dtex/24 f in Example 1, and that a yarn having a size of 112 dtex/48 f and prepared by doubling two latent crimp fiber each having a size of 56 dtex/24 f obtained in Preparation Example 1 was arranged at a back guide bar in place of the latent crimp fiber obtained in Preparation Example 1. The blending ratio of the latent crimp fiber was 40% by weight based on the knitted fabric.

EXAMPLE 9

A finished warp knitted fabric was obtained under the same knitting and dyeing conditions as in Example 1 except that a yarn having a size of 112 dtex/48 f and prepared by doubling two latent crimp fibers obtained in Preparation Example 1 was arranged at a back guide bar in place of the latent crimp fiber having a size of 56 dtex/24 f in Example 1. The blending ratio of the latent crimp fiber was 67% by weight based on the knitted fabric.

EXAMPLE 10

A finished warp knitted fabric was obtained under the same knitting and dyeing conditions as in Example 1 except that a non-latent crimp poly(ethylene terephthalate) fiber having a size of 33 dtex/24 f was arranged at a front guide bar in place of the non-latent crimp poly(trimethylene terephthalate) fiber having a size of 56 dtex/24 f in Example 9. The blending ratio of the latent crimp fiber was 78% by weight based on the knitted fabric.

EXAMPLE 11

A finished warp knitted fabric was obtained under the same knitting and dyeing conditions as in Example 1 except that a yarn having a size of 112 dtex/48 f and prepared by doubling two non-latent crimp poly(trimethylene terephthalate) fibers each having a size of 56 dtex/24 f was arranged at a front guide bar in place of the non-latent crimp poly(trimethylene terephthalate) fiber having a size of 56 dtex/24 f in Example 1. The blending ratio of the latent crimp fiber was 21% by weight based on the knitted fabric.

COMPARATIVE EXAMPLE 3

A finished warp knitted fabric was obtained under the same knitting and dyeing conditions as in Example 11 except that a yarn having a size of 18 dtex/8 f and prepared by splitting the latent crimp fiber having a size of 56 dtex/24 f and obtained in Preparation Example 1 into 3 was arranged at a back guide bar in place of the latent crimp fiber having a size of 56 dtex/24 f and obtained in Preparation Example 1. The blending ratio of the latent crimp fiber was as low as 9% by weight based on the knitted fabric.

COMPARATIVE EXAMPLE 4

A finished warp knitted fabric was obtained under the same knitting and dyeing conditions as in Example 1 except that the latent crimp fiber composed of a poly(ethylene terephthalate) and obtained in Preparation Example 8 was arranged at a back guide bar in place of the latent crimp fiber obtained in Preparation Example 1.

COMPARATIVE EXAMPLE 5

A finished warp knitted fabric was obtained under the same knitting and dyeing conditions as in Example 1 except that a non-latent crimp poly(ethylene terephthalate) fiber was arranged at a back guide bar in place of the latent crimp fiber obtained in Preparation Example 1.

COMPARATIVE EXAMPLE 6

A finished warp knitted fabric was obtained under the same knitting and dyeing conditions as in Example 1 except that a false-twisted yarn of a non-latent crimp poly(ethylene terephthalate) fiber was arranged at a back guide bar in place of the latent crimp fiber obtained in Preparation Example 1.

COMPARATIVE EXAMPLE 7

The procedure of Example 1 was changed, and the changed procedure was conducted in the following manner. A polyurethane elastic fiber (trade name of Roica, SC type, manufactured by Asahi Kasei Co., Ltd.) warped at a draft of 80% and having a size of 44 dtex was arranged at a back guide bar in place of the latent crimp fiber obtained in Preparation Example 1, and a knitted fabric with a half tricot stitch was formed with the same tricot knitting machine as in Example 1. During the preparation of the knitted fabric, the runner length was as follows: 160 cm/480 courses at a front guide bar; and 85 cm/480 courses at a back guide bar. The knitted fabric thus formed was finished under the same dyeing conditions as in Example 1 to give a warp knitted fabric.

EXAMPLE 12

The procedure of Example 1 was changed, and the changed procedure was conducted in the following manner. A knitted fabric was formed with a half tricot stitch by arranging the latent crimp fiber having a size of 56 dtex/12 f and obtained in Preparation Example 5 at a back guide bar in place of the latent crimp fiber obtained in Preparation Example 1, and changing the gauge of the tricot knitting machine in Example 1 from 28 gauge to 32 gauge. During the preparation of the knitted fabric, the runner length was as follows: 151 cm/480 courses at a front guide bar; and 105 cm/480 courses at a back guide bar. The knitted fabric thus formed was finished under the same dyeing conditions as in Example 1 to give a warp knitted fabric. The blending ratio of the latent crimp fiber was 41% based on the knitted fabric.

EXAMPLE 13

A finished warp knitted fabric was obtained under the same knitting and dyeing conditions as in Example 12 except that a non-latent crimp poly(ethylene terephthalate) fiber having a size of 56 dtex/24 f was arranged at a front guide bar in place of the non-latent crimp poly(trimethylene terephthalate) fiber in Example 12. The blending ratio of the latent crimp fiber was 38% by weight based on the knitted fabric.

Tables 2 to 5 show the evaluation results of the knitted fabrics and swimwear obtained in Examples 1 to 13 and Comparative Examples 1 to 7.

TABLE 2

| | | Ex. 1 | Ex. 2 | Ex. 3 | Ex. 4 | Ex. 5 | Ex. 6 |
|---|---|---|---|---|---|---|---|
| Structure of bars | Front | PTT 56 dtex | PTT 56 dtex | PTT 56 dtex | PTT 56 dtex | (Prepn. Ex. 1) PTT/PTT 56 dtex | PET 56 dtex |
| | Back | (Prepn. Ex. 1) PTT/PTT 56 dtex | (Prepn. Ex. 2) PTT/PTT 56 dtex | (Prepn. Ex. 3) PTT/PTT 56 dtex | (Prepn. Ex. 4) PTT/PTT 56 dtex | (Prepn. Ex. 1) PTT/PTT 56 dtex | (Prepn. Ex. 1) PTT/PTT 56 dtex |
| Blending ratio of latent crimp fiber | | 41% | 40% | 40% | 39% | 100% | 38% |
| Number of yarn breakage (times/480 courses) | | 0.05 | 0.05 | 0.07 | 0.08 | 0.53 | 0.04 |
| Fullness ($L_WCF$) | | 680 | 638 | 676 | 650 | 780 | 592 |
| Ratio of knitted fabric density (wales/courses) | | 0.71 | 0.68 | 0.67 | 0.65 | 0.82 | 0.66 |
| Stretchability (%) | Warp direction | 87 | 85 | 90 | 91 | 80 | 81 |
| | Weft direction | 134 | 126 | 147 | 150 | 144 | 126 |
| Residual strain (%) | Warp direction | 4 | 6 | 4 | 3 | 7 | 7 |
| | Weft direction | 3 | 5 | 4 | 3 | 6 | 5 |
| Smoothness of knitted fabric | | ○ | ○ | ○ | ○ | Δ | ○ |
| Denseness of knitted fabric | | 5 | 5 | 5 | 5 | 5 | 4 |
| Shape retention of knitted fabric | | ○ | ○ | ○ | ○ | ○ | ○ |
| Flexibility of knitted fabric ($\mu N \cdot cm$) | | 148 | 140 | 147 | 164 | 316 | 177 |
| Durability of knitted fabric (swimwear) | | ○ | ○ | ○ | ○ | ○ | ○ |
| Durability of knitted fabric (innerwear) | | ○ | ○ | ○ | ○ | ○ | ○ |
| Fitting feeling of swimwear | | 5 | 5 | 5 | 5 | 5 | 5 |

TABLE 3

| | | Ex. 7 | Ex. 8 | Ex. 9 | Ex. 10 | C. Ex. 1 | C. Ex. 2 |
|---|---|---|---|---|---|---|---|
| Structure of bars | Front | PET 84 dtex | PTT 112 dtex | PTT 56 dtex | PET 33 dtex | PTT 56 dtex | PTT 56 dtex |
| | Back | (Prepn. Ex. 1) PTT/PTT 56 dtex | (Prepn. Ex. 1) PTT/PTT 112 dtex | (Prepn. Ex. 1) PTT/PTT 112 dtex | (Prepn. Ex. 1) PTT/PTT 112 dtex | (Prepn. Ex. 6) PTT/PTT 56 dtex | (Prepn. Ex. 7) PTT/PTT 56 dtex |
| Blending ratio of latent crimp fiber | | 27% | 40% | 67% | 78% | 39% | 41% |
| Number of yarn breakage (times/480 courses) | | 0.02 | 0.41 | 0.35 | 0.37 | 0.70 | 0.06 |

TABLE 3-continued

| | | Ex. 7 | Ex. 8 | Ex. 9 | Ex. 10 | C. Ex. 1 | C. Ex. 2 |
|---|---|---|---|---|---|---|---|
| Fullness ($L_W$CF) | | 530 | 973 | 868 | 890 | 406 | 392 |
| Ratio of knitted fabric density (wales/courses) | | 0.80 | 0.81 | 0.84 | 0.75 | 0.57 | 0.54 |
| Stretchability (%) | Warp direction | 78 | 62 | 78 | 79 | 52 | 41 |
| | Weft direction | 120 | 97 | 109 | 112 | 73 | 50 |
| Residual strain (%) | Warp direction | 10 | 10 | 6 | 6 | 16 | 23 |
| | Weft direction | 8 | 10 | 4 | 5 | 11 | 18 |
| Smoothness of knitted fabric | | ○ | Δ | Δ | Δ | Δ | ○ |
| Denseness of knitted fabric | | 4 | 5 | 5 | 5 | 2 | 2 |
| Shape retention of knitted fabric | | Δ | ○ | ○ | ○ | Δ | Δ |
| Flexibility of knitted fabric ($\mu$N · cm) | | 198 | 279 | 187 | 181 | 103 | 87 |
| Durability of knitted fabric (swimwear) | | ○ | ○ | ○ | ○ | ○ | Δ |
| Durability of knitted fabric (innerwear) | | ○ | ○ | ○ | ○ | ○ | Δ |
| Fitting feeling of swimwear | | 4 | 4 | 5 | 5 | 2 | 1 |

TABLE 4

| | | Ex. 11 | C. Ex. 3 | C. Ex. 4 | C. Ex. 5 | C. Ex. 6 | C. Ex. 7 |
|---|---|---|---|---|---|---|---|
| Structure of bars | Front | PTT 112 dtex (Prepn. Ex. 1) | PTT 112 dtex (Prepn. Ex. 1)* | PTT 56 dtex (Prepn. Ex. 8) | PTT 56 dtex Non-latent crimp fiber | PTT 56 dtex False-twisted yarn of non-latent crimp fiber | PTT 56 dtex Elastic fiber 44 dtex |
| | Back | PTT/PTT 56 dtex | PTT/PTT 18 dtex | PET/PET 56 dtex | PET 56 dtex | PET 56 dtex | |
| Blending ratio of latent crimp fiber | | 21% | 9% | 40% | 0% | 0% | 0% |
| Number of yarn breakage (times/480 courses) | | 0.02 | 0.02 | 1.00 | 0.00 | 0.00 | 0.00 |
| Fullness ($L_W$CF) | | 583 | 479 | 474 | 317 | 381 | 680 |
| Ratio of knitted fabric density (wales/courses) | | 0.66 | 0.69 | 0.67 | 0.55 | 0.58 | 0.55 |
| Stretchability (%) | Warp direction | 61 | 52 | 54 | 25 | 52 | 160 |
| | Weft direction | 78 | 71 | 70 | 31 | 65 | 131 |
| Residual strain (%) | Warp direction | 15 | 17 | 16 | 53 | 26 | 9 |
| | Weft direction | 14 | 11 | 12 | 50 | 14 | 8 |
| Smoothness of knitted fabric | | ○ | Δ | ○ | Δ | X | ○ |
| Denseness of knitted fabric | | 3 | 2 | 2 | 1 | 1 | 5 |
| Shape retention of knitted fabric | | Δ | Δ | Δ | X | X | ○ |
| Flexibility of knitted fabric ($\mu$N · cm) | | 216 | 118 | 100 | 37 | 53 | 262 |
| Durability of knitted fabric (swimwear) | | ○ | ○ | ○ | Δ | Δ | X |
| Durability of knitted fabric (innerwear) | | ○ | ○ | ○ | Δ | Δ | X |
| Fitting feeling of swimwear | | 3 | 2 | 2 | 1 | 3 | 5 |

Note: *Split

TABLE 5

| | | Ex. 12 | Ex. 13 |
|---|---|---|---|
| Structure of bars | Front | PTT 56 dtex | PET 56 dtex |
| | Back | (Prepn. Ex. 5) PTT/PTT 56 dtex | (Prepn. Ex. 5) PTT/PTT 56 dtex |
| Blending ratio of latent crimp fiber | | 41% | 38% |
| Number of yarn breakage (times/480 courses) | | 0.23 | 0.21 |
| Fullness ($L_W$CF) | | 794 | 762 |
| Ratio of knitted fabric density (wales/courses) | | 0.87 | 0.85 |
| Stretchability (%) | Warp direction | 87 | 82 |
| | Weft direction | 120 | 112 |
| Residual strain (%) | Warp direction | 4 | 7 |
| | Weft direction | 3 | 5 |
| Smoothness of knitted fabric | | ○ | ○ |
| Denseness of knitted fabric | | 5 | 5 |
| Shape retention of knitted fabric | | ○ | ○ |
| Flexibility of knitted fabric ($\mu$N · cm) | | 168 | 155 |
| Durability of knitted fabric (swimwear) | | ○ | ○ |
| Durability of knitted fabric (innerwear) | | ○ | ○ |
| Fitting feeling of swimwear | | 5 | 5 |

The following cab be understood from Tables 2 to 5.

Because latent crimp fibers excellent in crimp were used in Examples 1 to 4, 6, 7 and 11, yarn breakage hardly took place during knitting, and warp knitted fabrics excellent in stretchability and denseness could be obtained. Moreover, the knitted fabrics gave the wearers an excellent fitting feeling in the evaluation by wearing swimsuits.

Furthermore, in Examples 12 and 13, warp knitted fabrics excellent in stretchability and denseness could be obtained even when a number of filaments of a latent crimp fiber and a gauge during knitting were changed.

Yarn breakage took place more during knitting, and the warp knitted fabrics showed poorer stretchability in Examples 5, 8, 9 and 10 than in Examples 1 to 3, 6 and 7. However, warp knitted fabrics giving an excellent fitting feeling when used for swimwear and an excellent dense feeling could be obtained.

Because the warp knitted fabric in Example 5 was formed from latent crimp fibers alone, it was poor in a feeling and flexibility to some degree and somewhat rough to the touch, although it was excellent in denseness and stretchability.

Because the latent crimp fibers were poor in crimp in Comparative Examples 1, 2 and 4, yarn breakage often took place on the knitting machine. Because the blending ratio of a latent crimp fiber was low in Comparative Example 3, the warp knitted fabric showed a low stretchability and gave a poor fitting feeling.

Furthermore, because the fibers used in Comparative Example 5 had no crimp, yarn breakage hardly took place on the knitting machine, and the fibers were excellent in stabilized production of the warp knitted fabric. However, the knitted fabric thus obtained showed significantly low stretchability, had poor denseness, and gave a poor fitting feeling when used as swimwear.

The warp knitted fabric in Comparative Example 6 was formed from a fiber to which crimp was imparted by false twisting. The production stability of the warp knitted fabric was good, to some extent, and the knitted fabric showed stretchability to some degree. However, because bulkiness was imparted to the yarn by false twisting, the knitted fabric thus obtained showed extremely poor surface smoothness and denseness.

Because an elastic fiber was used in Comparative Example 7, the warp knitted fabric gave a heavy feeling due to the excessive denseness and showed poor flexibility to some degree, although the fabric was excellent in stretchability and residual strain. Moreover, the knitted fabric in Comparative Example 7 showed extremely poor durability in comparison with the other warp knitted fabrics in the other examples and comparative examples.

EXAMPLE 14

Spats type swimwear for men was prepared from the warp knitted fabric produced in Example 1. A man wore the swimwear thus obtained, and swam in a pool for about 10 minutes. The swimwear gave the wearer an excellent wearable feeling and no unpleasant feeling.

EXAMPLE 15

Spats (upper garment, undergarment) were prepared from the warp knitted fabric produced in Example 1, and used for a running test for about 2 hours. The spats thus prepared gave the wearer an excellent wearable feeling and no unpleasant feeling. Moreover, the wearer's fatigue caused by the movement could be reduced.

EXAMPLE 16

An undershirt for baseball was prepared from the warp knitted fabric produced in Example 1. A wearer wore the undershirt, and it gave the wearer an excellent feeling. Moreover, the wearer's fatigue caused by movement could be reduced.

EXAMPLE 17

Shorts for women were prepared from the warp knitted fabric produced in Example 1. One woman wore the shorts, and they gave the wearer an excellent wearable feeling.

INDUSTRIAL APPLICABILITY

The warp knitted fabric of the present invention is excellent in a soft feeling, stretchability, surface smoothness, denseness, shape stability, a fitting feeling during wearing and adaptability to body movement. The fabric is also excellent in durability of the above functions. In more detail, because the warp knitted fabric of the invention shows extremely high stretchability and reduced residual strain, it is excellent in elongation properties, elongation recovery and shape retention. Moreover, the warp knitted fabric is excellent in see-through prevention and color developing properties, and has burst strength, tear strength and resistance to pilling and snagging that are well suited to practical use. Moreover, the warp knitted fabric is excellent in resistance to embrittlement caused by physical and chemical actions, and shows little lowering of the above functions.

Because clothing for which the warp knitted fabric of the present invention is used is easily worn and removed, and excellent in adaptability to the body movement, the warp knitted fabric is appropriate to clothing to be closely contacted with the body, for example, sportswear such as swimwear and spats, underwear, and outerwear such as stretch bottoms.

What is claimed is:

1. A warp knitted fabric comprising a warp knitted fabric containing a latent crimp fiber, but no elastic fiber, said latent crimp fiber being formed from two polymers, at least one of said polymers being poly(trimethylene terephthalate) and said warp knitted fabric having a stretchability of 60% or more in both the warp and weft directions, and a residual strain at 60% elongation recovery of 15% or less in both the warp and weft directions.

2. The warp knitted fabric according to claim 1, wherein the latent crimp fiber is knitted at a blending ratio of 10% or more by weight based on the knitted fabric.

3. The warp knitted fabric according to claim 1, wherein the warp knitted fabric is formed from the latent crimp fiber and a non-latent crimp fiber, and the latent crimp fiber is mixed knitted at a blending ratio of from 10 to 80% by weight based on the knitted fabric.

4. The warp knitted fabric according to any one of claims 1 to 3, wherein the latent crimp fiber is compositely formed from two types of polyesters, and at least one of the polyesters is poly(trimethylene terephthalate).

5. The warp knitted fabric according to any one of claims 1 to 3, wherein the latent crimp fiber is compositely formed from two types of polyesters differing from each other in intrinsic viscosity in an amount of from 0.05 to 0.7 dl/g, in a side-by-side manner or in an eccentric core-sheath manner, and at least one of the polyesters is poly(trimethylene terephthalate).

6. The warp knitted fabric according to any one of claims 1 to 3, wherein the latent crimp fiber satisfies the following condition (a) to (c):

(a) an initial tensile resistance of from 10 to 30 cN/dtex;

(b) a stretch elongation of crimp is from 10 to 100% and a stretch modulus of crimp is from 80 to 100%; and (c) a thermal shrinkage stress at 100° C. of from 0.1 to 0.5 cN/dtex.

7. The warp knitted fabric according to any one of claims 1 to 3, wherein the latent crimp fiber is compositely formed from two types of poly(trimethylene terephthalates) differing from each other in intrinsic viscosity in an amount of from 0.05 to 0.5 dl/g, in a side-by-side manner or in an eccentric core-sheath manner.

8. The warp knitted fabric according to claim 3, wherein the non-latent crimp fiber is a polyester-based and/or polyamide-base synthetic fiber.

9. The warp knitted fabric according to any one of claims 1 to 3, wherein the latent crimp fiber is compositely formed from two types of poly(trimethylene terephthalates) differing from each other in intrinsic viscosity in an amount of from 0.05 to 0.3 dl/g, in a side-by-side manner.

10. The warp knitted fabric according to claim 3 or 8, wherein the warp knitted fabric is formed from the latent crimp fiber and the non-latent crimp fiber, and the latent crimp fiber is mixed knitted in a blending ratio from 25 to 80% by weight based on the knitted fabric.

11. The warp knitted fabric according claim 3 or 8, wherein the warp knitted fabric is formed from the latent crimp fiber and the non-latent crimp fiber, and the latent crimp fiber is mixed knitted in a blending ratio of from 35 to 80% by weight based on the knitted fabric.

12. The warp knitted fabric according to any one of claims 1 to 3 and 8, wherein the fullness ($L_wCF$) in the wale direction of the warp knitted fabric is from 500 to 1,500.

13. The warp knitted fabric according to any one of claims 1 to 3 and 8, wherein the ratio (number of wales/number of courses) of a knitted fabric density in the wale direction to a knitted fabric density in the course direction is from 0.6 or more to 1.0 or less.

14. The warp knitted fabric according to any one of claims 1 to 3 and 8, wherein the knitting stitch of the warp knitted fabric is a half tricot stitch.

15. Swimwear made from the warp knitted fabric according to any one of claims 1 to 3 and 8.

16. Sportswear made from the warp knitted fabric according to any one of claims 1 to 3 and 8.

17. Underwear made from the warp knitted fabric according to any one of claims 1 to 3 and 8.

* * * * *